US008622760B2

(12) United States Patent
Alaria et al.

(10) Patent No.: US 8,622,760 B2
(45) Date of Patent: Jan. 7, 2014

(54) ELECTRIC CONNECTOR, PARTICULARLY FOR A DRILL STRING

(75) Inventors: Luigi Alaria, Grosso (IT); Angelo Canavera, Volpiano (IT)

(73) Assignee: PE. Gas. US. SRL, Cirie (Torino) (IT)

( * ) Notice: Subject to any disclaimer, the term of this patent is extended or adjusted under 35 U.S.C. 154(b) by 230 days.

(21) Appl. No.: 13/113,544

(22) Filed: May 23, 2011

(65) Prior Publication Data

US 2011/0294343 A1 Dec. 1, 2011

(30) Foreign Application Priority Data

May 28, 2010 (IT) ..... TO2010A0452

(51) Int. Cl.
*H01R 4/60* (2006.01)

(52) U.S. Cl.
USPC ..... 439/195

(58) Field of Classification Search
USPC ..... 439/527, 191, 195, 164
See application file for complete search history.

(56) References Cited

U.S. PATENT DOCUMENTS 3,879,097 A * 4/1975 Oertle ..... 340/855.1
4,286,834 A * 9/1981 Goodman et al. ..... 439/191
4,700,743 A * 10/1987 L'Henaff et al. ..... 137/560
5,713,765 A 2/1998 Nugent
6,929,493 B2 8/2005 Hall et al.
8,342,865 B2 * 1/2013 Scheibelmasser et al. ... 439/191
2005/0074988 A1 4/2005 Hall et al.
2005/0098356 A1 * 5/2005 Chau ..... 175/321
2006/0021799 A1 2/2006 Hall et al.

OTHER PUBLICATIONS

Italian Search Report of IT TO20100452 dated Jan. 6, 2011.
European Search Report for EP 11167574, issued Jul. 27, 2011.

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

Electric connector, including first and second connector parts which can be coupled to each other and comprise first and second contact elements, and first and second supports, respectively, which support the first and second connector parts, respectively, and can be assembled to each other by means of a screw- or bayonet-fitting.
The first connector part comprises a resilient support structure, a proximal end thereof being made integral with the first support, and a distal end thereof supporting the first contact element. The second connector part comprises an abutment ring which is suitable to be slidingly engaged by the first contact element during the fitting between the first and second supports. The second contact element is located at a limited circumferential arc of the abutment ring, and a stop projection is provided which is suitable to stop the first contact element at the second contact element in order to provide the coupling with the connector parts.

15 Claims, 7 Drawing Sheets

ELECTRIC CONNECTOR, PARTICULARLY FOR A DRILL STRING

The present invention relates to an electrical connector, including first and second connector parts being couplable to each other and comprising first and second contact elements, respectively, suitable for closing an electric contact with one another when first and second connector parts are coupled to each other, and first and second supports, which support the first and second connector parts, respectively, and are mountable to one another by means of bayonet or screw fitting for obtaining the coupling between the first and second connector parts, wherein said first connector part comprises a resilient support structure, a first proximal end thereof being integral to the first support, and a distal end thereof supporting the first contact element, and wherein said second connector part comprises an abutment ring adapted to be slidingly engaged by the first contact element during the fitting between the first and second supports, said abutment ring housing the second contact element.

Connectors of this type are used particularly in the oil and methane industries, in the field of construction of power lines within the drill strings used in the construction of drilling wells. These power lines are used to transmit to the surface signals representative of the conditions of operation of the drilling equipment, or of the geological or environmental conditions within the well.

Generally, the strings used comprise hundreds of pipes and any other components connected in series. The power lines must therefore transmit their signals through all the joints between successive components of the strings. Consequently, a single faulty connections may result in the malfunctioning of the entire line.

There are different factors affecting the reliability of connectors. First, because in general the connection between the drill string components is done by screwing, and because the manufacturing tolerances of the drilling components generally do not reach the level of precision required by electrical equipment, upon completing the assembly it may occur that the electrical contacts of successive components are not aligned with each other, and/or that there is still an axial gap between them that prevents the achievement of the contact. In addition, a certain angular displacement between a component and another can occur accidentally during the operation of the drill string, thereby causing misalignment of the contacts.

These issues have been addressed for example in U.S. Pat. No. 6,929,493, which describes an electrical connector of the type defined herein in the preamble. The connector of U.S. Pat. No. 6,929,493 includes a pair of annular contacts, which are received in respective annular seats by being drowned in an elastic material. Although this device appears to solve the above problems, however, it seems to be able to cover only those manufacturing tolerances that are not too large, and certainly does not seems to be able to cope with a situation where there is a significant relative angular displacement and therefore also a significant approach, between a component and another of the battery.

An object of the invention is therefore to provide an electrical connector which effectively solves the above problems.

Accordingly, the object of the invention is an electric connector as defined above, in which said second contact element is positioned at a limited circumferential arc of the abutment ring, stop means being provided for stopping the first contact element at the second contact element for providing the coupling between the first and second connector parts, wherein in the coupled condition the resilient support structure of the first connector part biases the first contact element in the axial direction against the abutment ring, and in the circumferential direction against said stop means.

According to this provision, the flexible coupling between the resilient structure and the abutment ring allows not only to avoid misalignment and axial spaces between the electrical contacts upon assembly, but also allows to compensate for relative angular displacements between the supports during the operation, as well as to withstand the subsequent rapprochement between the supports.

Electric connection devices according to claims 10 and 15 are also a subject of the invention.

Further characteristics and advantages of the present invention will be better understood from the following detailed description, with reference to the annexed drawings that are given by way of non-limiting examples, in which.

Figure 1:
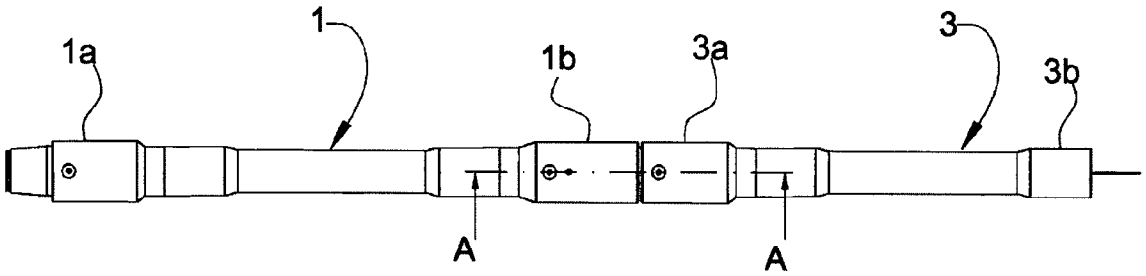
FIG. 1 is a side elevation view of a pair of drill pipes during the assembly step.

FIG. 1 shows a pair of drill pipes, indicated respectively by references 1 and 3. Although the invention will be described as being applied to these pipes, it is understood that it is not limited to that specific application, as it can find employment in other technology areas in addition to the drilling of the ground. These pipes are conventionally made of tubular elements, to which ends are fixed, usually by soldering, connection end elements which are intended to implement the joint between consecutive pipes of a drill string (the so-called "tool joints"). These end elements are generally provided with tapered threads. In particular, the end elements that are intended to make the male part of the joints, and which are provided with an external thread have been indicated with 1*a* and 3*a* in FIG. 1, whereas the end elements that are intended to make the female part of joints, and which are provided with an internal thread have been designated with 1*b* and 3*b*.

Figure 2:
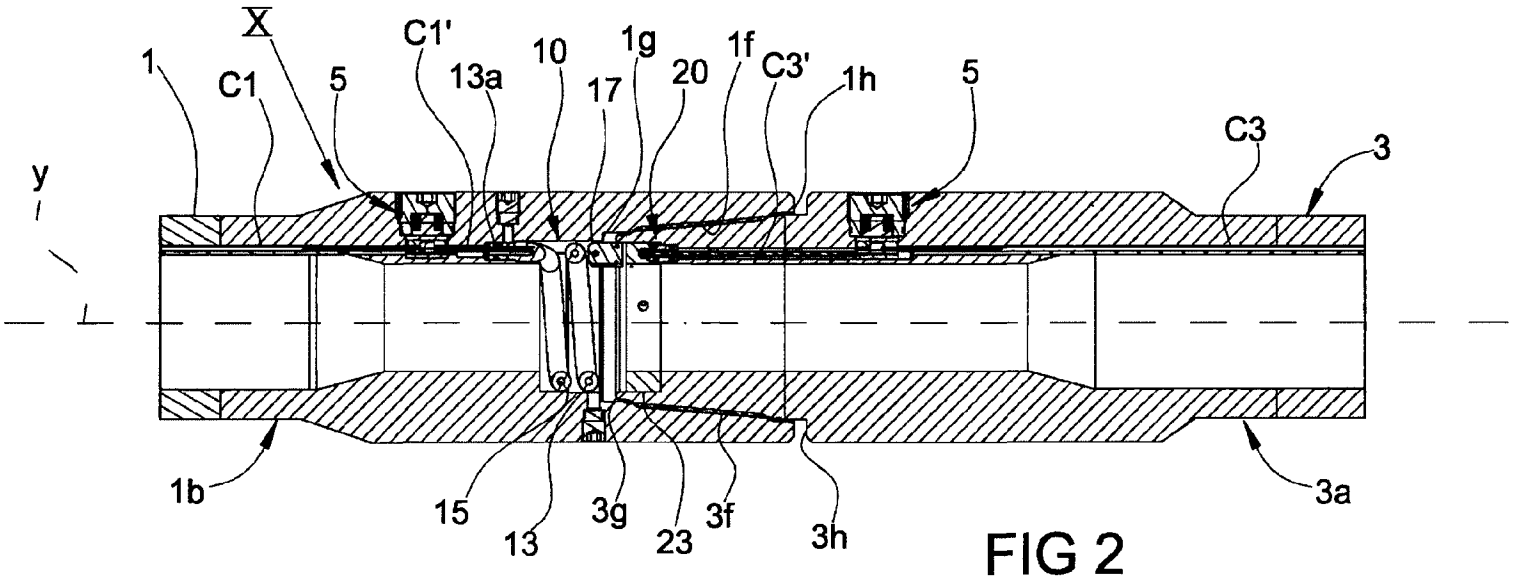
FIG. 2 is a sectional view, taken along the line AA of FIG. 1.
Figure 3:
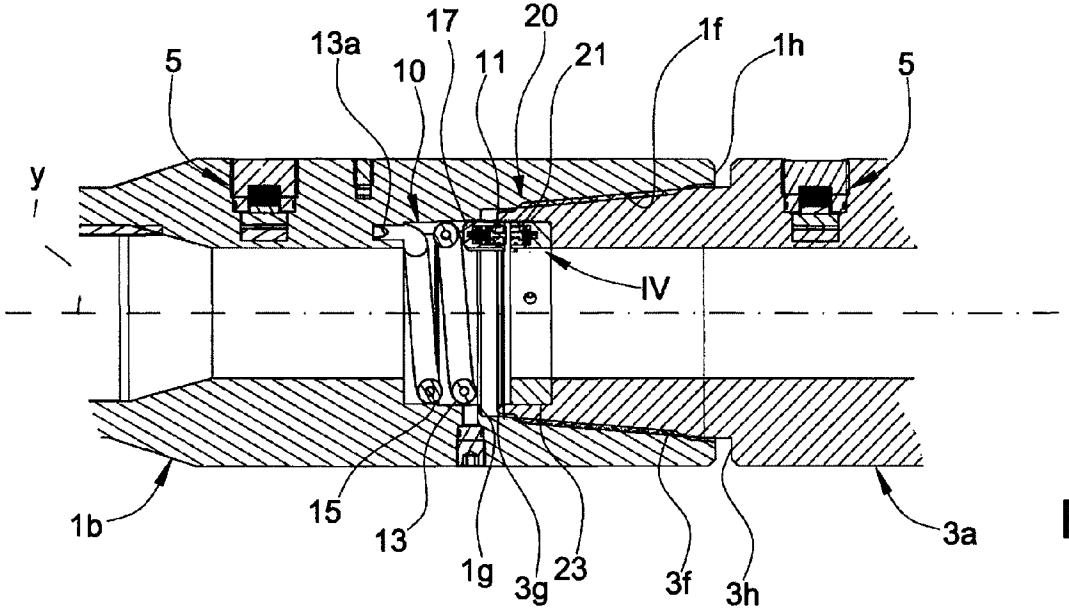
FIG. 3 is a view similar to FIG. 2, but on an enlarged scale.
Figure 5:
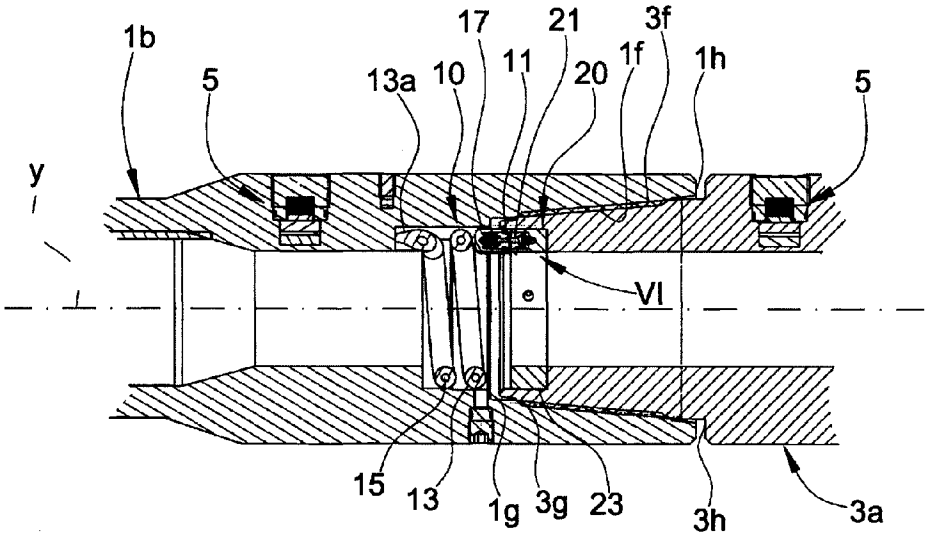
FIG. 5 is a view similar to FIG. 3, wherein the pipes are further screwed together in order to obtain an electric contact between the respective contact elements.

FIGS. 2 and 3 shows more clearly a male end element 3*a* and a female end element 1*b* when the assembly has not yet been completed. In the figure are visible the internal thread 1*f* and external thread 3*f* of the female end element 1*b* and male end element male 3*a*. Primary and secondary shoulder surfaces 1*g*, 1*h* are further provided on the female end element 1*b*, which are arranged at opposite ends of the internal thread 1*f*; corresponding primary and secondary shoulder surfaces 3*g*, 3*h* are provided on the male end element 3*a*, which surfaces are arranged at the opposite ends of the external thread 3*f*. FIGS. 2 and 3 show that between corresponding shoulder surfaces 1*g*, 3*g* and 1*h*, 3*h*, there is a certain distance which indicates that the screw coupling between the female end element 1*b* and the male end element 3*a* has not yet been completed. FIG. 5 shows female end element 1*b* and male end element 3*a* when the coupling has not yet been completed, in a condition in which these elements are however further screwed together relative to the condition in FIGS. 2 and 3. In the condition of full coupling (not shown) the distance between corresponding shoulder surfaces 1*g*, 3*g* and 1*h*, 3*h* is substantially reduced to zero, except for manufacturing tolerances.

Figure 10:
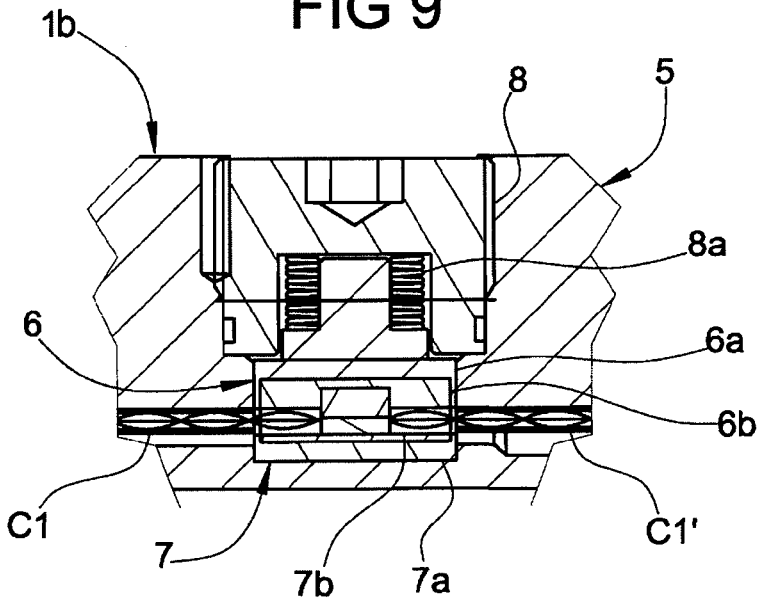
FIG. 10 is an enlarged view of a detail indicated by X in FIG. 2.

On the inner surface of each drill pipe 1, 3 is placed a respective piece of electric cable C1, C3. Preferably, this piece of cable C1, C3 is embedded in a coating of ceramic material, which by hardening causes the wire to be integral with the respective inner surface of the tube. At the end elements 1*a*, 1*b* and 3*a*, 3*b* is arranged a further respective piece of cable, indicated by C1', C3', which is passed through holes or grooves made in the body of the end elements. Within each drill pipe 1, 3 the piece of cable C1, C3 of the middle part of the pipe is connected to each of the pieces of cable C1', C3' of the end elements by respective internal connection members 5, which are housed in respective seats being provided in the end elements of the pipes. One of these internal connection members is illustrated in greater detail in FIG. 10 and is, in this example, implemented as a screw tightening clamp. As a result, the member 5 includes first and second parts of the terminal 6, 7, each of which includes a housing 6*a*, 7*a* made of an insulating material, inside which a respective contact body 6*b*, 7*b* is arranged, which is made of electrically conductive material. To secure the first and second parts of the terminal 6, 7 to each other, a clamping element 8 is provided, which comprises a bush having an external thread capable of engaging a corresponding internal thread that is provided within the seat which houses the connection member 5. By means of elastic means 8*a* being interposed between the clamping element and the first part of the terminal 6, the clamping element 8 screwed within the seat urges the first part of the terminal 6 against the second part of the terminal 7, which rests against the bottom the seat, thereby providing the clamping connection member 5. The ends of the cable pieces C1, C1' are interposed between the first part of the terminal 6 and the second part of the terminal 7, in contact with the contact bodies 6*b*, 7*b*, which ends are inserted from opposite sides relative thereto.

Female end element 1*b* and male end element 3*a* support first and second parts of connector, which are indicated with 10 and 20, respectively. These first and second parts of connector 10, 20 are housed in respective annular seats that are obtained in the primary shoulder surfaces 1*g* and 3*g* of the female end element 1*b* and male end element 3*a*, and are therefore arranged co-axially with the common axis of extension y defined by the drill pipes 1 and 3, relative to which, consequently, the female end element 1*b* and male end element 3*a* extend co-axially. In the example given herein, the y-axis is in fact also the axis of engagement of the pipes 1 and 3.

Figure 6:
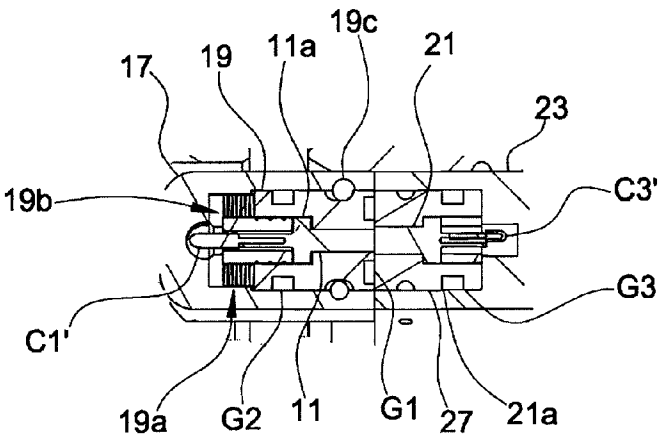
FIG. 6 illustrates an enlarged view of a detail indicated by VI in FIG. 5.

The first connector part 10 and the second connector part 20 are couplable to each other and comprise a first contact element 11 and a second contact element 21, respectively, which are made of a conductive material, that are suitable for closing an electric contact with one another when first and second connector parts are coupled to each other. This coupling between the first and second parts of the connector is achieved when the female end element 1*b* and the male end element 3*a* is at least partially grafted to each other, as shown in FIGS. 5 and 6.

Figure 7:
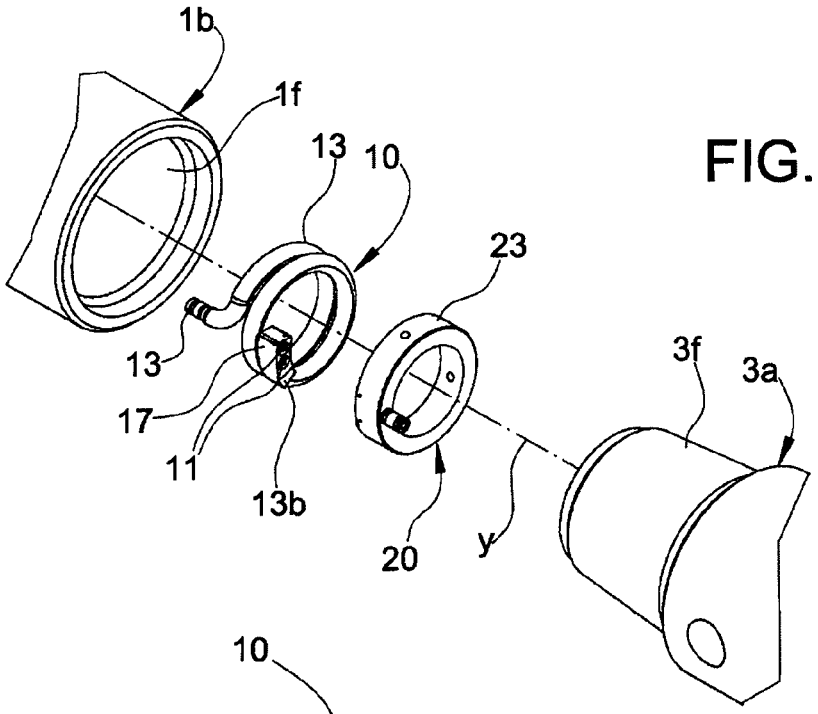
FIG. 7 is a simplified exploded view of the components of an electrical connector according to the invention.
Figure 8:
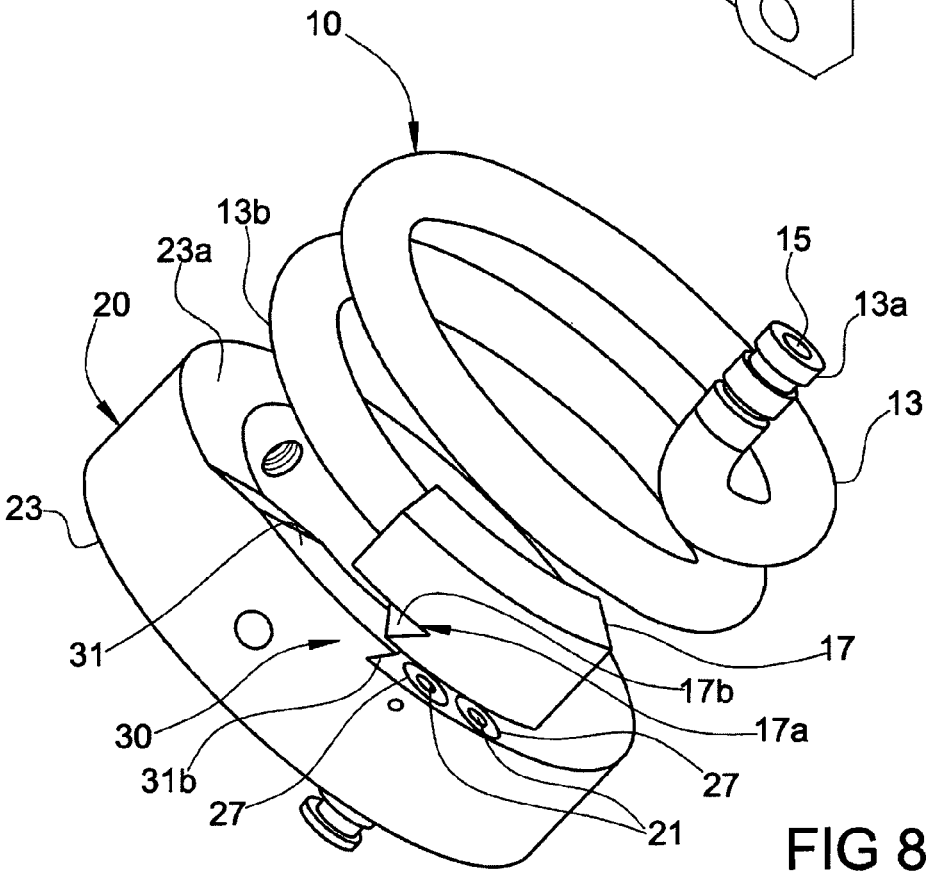
FIG. 8 is a perspective view of the connector in FIG. 7.

As can be more clearly seen in FIGS. 7 and 8, the first connector part 10 comprises a resilient support structure 13, a proximal end 13*a* thereof being made integral to the first support, and a distal end 13*b* thereof supporting the first contact element 11. The resilient support structure 13 has the shape of a coil spring extending co-axially with the axis of coupling y, and whose body has a hollow section. In the example shown, the hollow section is also circular. However, the circularity of the section is not essential, and this could also be different, for example square. Within the inner cavity 15 of the support elastic structure body 13 the end piece C1' is passed which is connected to the piece of electric cable C1, so as to electrically connect this cable to the first contact element 11 (for simplicity of representation the piece C1' within the cavity 15 is not illustrated). In this application, the resilient support structure 13 may be made of a metal material, e.g. steel.

At the distal end 13*b* of the resilient support structure 13, a box-like body 17 is fixed which is opened in the distal direction, the first contact element 11 being housed therein. As can be particularly seen in FIGS. 4 and 6, the first contact element 11 has the shape of a bar, and is provided with a middle flanged portion 11*a*. The first contact element 11 is slidingly inserted within an intermediate bush-shaped housing 19 that is made from insulating material, which is in turn slidingly inserted within the box-like body 17. The sliding direction of the first contact element 11 and the intermediate housing 19 is parallel to the y-axis. In the example shown herein, there are two first contact elements 11, connected to two respective leads of the electric cable C1', which in the example given herein is a bipolar cable.

Figure 4:
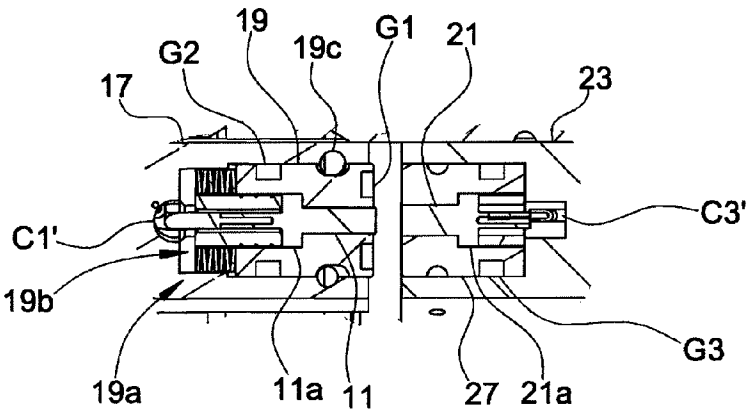
FIG. 4 is an enlarged view of a detail indicated by IV in FIG. 3.

The first contact element 11 and the intermediate housing 19 are biased, independently of each other, in the distal direction, so as to protrude outwardly from the distal surface of the box-like body 17, when the first part of the connector 10 is not coupled with the second part of connector 20 (condition shown in FIGS. 3 and 4). To this end, within the box-like body 17, resilient means 19*a* associated with the intermediate housing 19 and resilient means 19*b* associated with the first contact element 11 are accommodated co-axially with respect to each other. Particularly, the resilient means 19*a* consist of a pack of Belleville washers, which abuts on the one side against an inner surface of the box-like body 17 and on the other side abuts against a surface of the intermediate housing 19; the resilient means 19*b* consist of a tubular element made of elastic and insulating material being arranged around that end of the cable C1' which is connected to an end part of the first contact element 11, where said cylinder on the one side abuts against the inner surface of the box-like body 17, and on the other side abuts against the middle flanged portion 11*a* of the first contact element 11. A snap ring 19*c* interposed between the intermediate housing 19 and the box-like body 17 is arranged so as to define the maximum travel of the intermediate housing 19 outside the box-like body 17. On the other hand, a shoulder surface of the intermediate housing 19 cooperating with the flanged portion 11*a* of the first contact element 11 defines the maximum travel of the first contact element 11 outside the intermediate housing 19.

As can be seen most clearly in FIGS. 7 and 8, the second part of connector 20 comprises an abutment ring 23 suitable of being slidingly engaged by the first contact element 11 during the fitting between the pipes 1 and 3. The abutment ring 23 accommodates the second contact element 21. The contact element 21 is electrically connected to the end piece C3' connected with the piece of cable C3 associated with the second drill pipe 3. In this application, the abutment ring 23 may be made of metallic material, e.g. steel.

The second contact element 21 is located at a limited circumferential arc of the abutment ring 23. By limited circumferential arc is meant a circumferential arc of the circumference of the abutment ring 23 having a length such that the ratio of the length of the arc to the length of the circumference of the abutment ring is less than 1. Particularly, the second contact element 21 has the shape of a bar, and is provided with a middle flanged portion 21*a* (see FIGS. 4 and 6). The second contact element 21 is inserted in a steady state within a housing 27 that is bush-shaped and made of insulating material, which is in turn placed in a steady state within a hole in the body of the abutment ring 23. In the example shown herein, there are two second contact elements 21, connected to two respective leads of the electric cable C3', which in the example given herein consists of a bipolar cable. As can be seen particularly in FIG. 8, the second contact elements 21 and the respective housings 27 are arranged so as to have their respective distal surfaces flush with the distal annular surface 23*a* of the abutment ring 23, i.e. the surface on which the first contact element 11 slides in the final screwing step, between the first and second drill pipes 1, 3.

Figure 9:
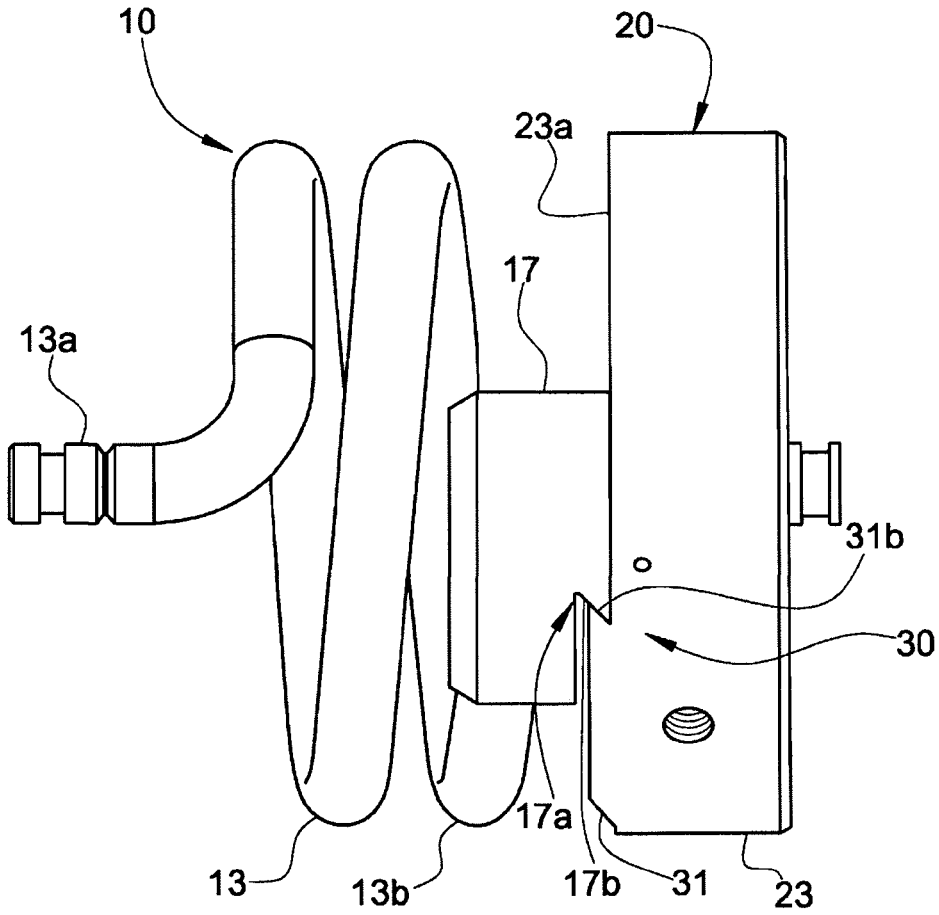
FIG. 9 is a side elevation view of the connector in FIG. 7 in the closed condition.

According to the invention stop means 30 are provided which are suitable to stop the first contact element 11 at the second contact element 21 to achieve the coupling between first and second parts of connector 10, 20, as shown in FIG. 9. In the condition of coupling between the first and second parts of connector 10, 20, the resilient support structure 13 of the first part of the connector 10 biases the first contact element 11 in the axial direction against the abutment ring 23 and in the circumferential direction against the stop means 30.

Preferably, the means 30 include a protruding formation 31 provided on the abutment ring 23, which axially protrudes from the distal annular surface 23*a* of the abutment ring 23. Such protruding formation is suitable to be engaged by a notch 17*a* which is shaped in a manner corresponding thereto and provided on the box-like body 17 within which the first contact element 11 is accommodated. Preferably, the projecting formation 31 and the notch 17*a* have respective undercut surfaces 31*b*, 17*b* by means of which they are intended to engage each other.

In the final screwing step between the drill pipes 1 and 3, at a certain point the first contact element 11 starts to engage the distal annular surface 23*a* of the abutment ring 23. When the screwing operation is continued, the contact element 11 and the intermediate housing 19 thereof are pushed inwardly of the box-like body 17, against the action of the pack of Belleville washers 19*a* and of the resilient element 19*b*. When a certain circumferential position is achieved for the abutment ring 23, the box-like body 17 abuts against the protruding formation 31 of the abutment ring 23, thereby preventing a further relative rotation of the box-like body 17 relative to the abutment ring 23. At this point, the first contact element 11 supported by the box-like body 17 is aligned with the respective contact element 21 supported by the abutment ring 23, thereby resulting in the closure of the electrical contact, and then the coupling between first and second parts of connector 10, 20. The sliding movement between the first contact element 11 and the abutment ring 23, which occurs in the final screwing step until the stop of the box-like body 17 against the protruding formation 31 causes a friction of the distal surfaces of the contact elements 11 and 21 which removes any dirt that may be present thereon. The further screwing between the drill pipes after the stop of the box-like body 17 against the protruding formation 31 has the effect of increasing the elastic load on the resilient support structure 13 until the completion of the fitting between the pipes.

The maintenance of the contact between the first and second contact elements 11, 21 is thus ensured by the resilient force of the resilient support structure 13 of the first connector part 10 which urges the first contact element 11 against the second contact element 21 and by the resilient means 19*b* which bias the first contact element 11 against the second contact element 21. To prevent electrical parts from being reached by water, mud and other fluids during operation, gaskets G1, G2, G3 have been provided, which are placed:

- on the distal surface of the intermediate housing 19 around the first intermediate contact element 11 (gasket G1);
- between the intermediate housing 19 and the box-like body 15 (O-ring G2), and
- between enclosure 27 of the second contact element 21 and the abutment ring 23 (O-ring G3).

The undercut surfaces 17*b* and 31*b* of the box-like body 17 and of the protruding formation 31 of the abutment ring 23 act as an inclined plane that contribute along with the resilient force of the resilient support structure 13 of the first connector part 10 to hold the box-like body 17, and accordingly the contact element 11 against the abutment ring 23, and then against the second contact element 21.

If, during assembly or in operation, a further relative angular displacement should occur between the first and second drill pipes 1, 3, this movement would not cause any misalignment of the contact elements 11, 21, but simply a further deformation of the resilient support structure 13, which has the beneficial effect of increasing the elastic force that biases the first contact element 11 in the axial direction against the abutment ring 23, and in the circumferential direction against the protruding formation 31 of the abutment ring 23. The resilient support structure 13 also supports the crushing increase which is due to the rapprochement between the pipe end elements.

Figure 11:
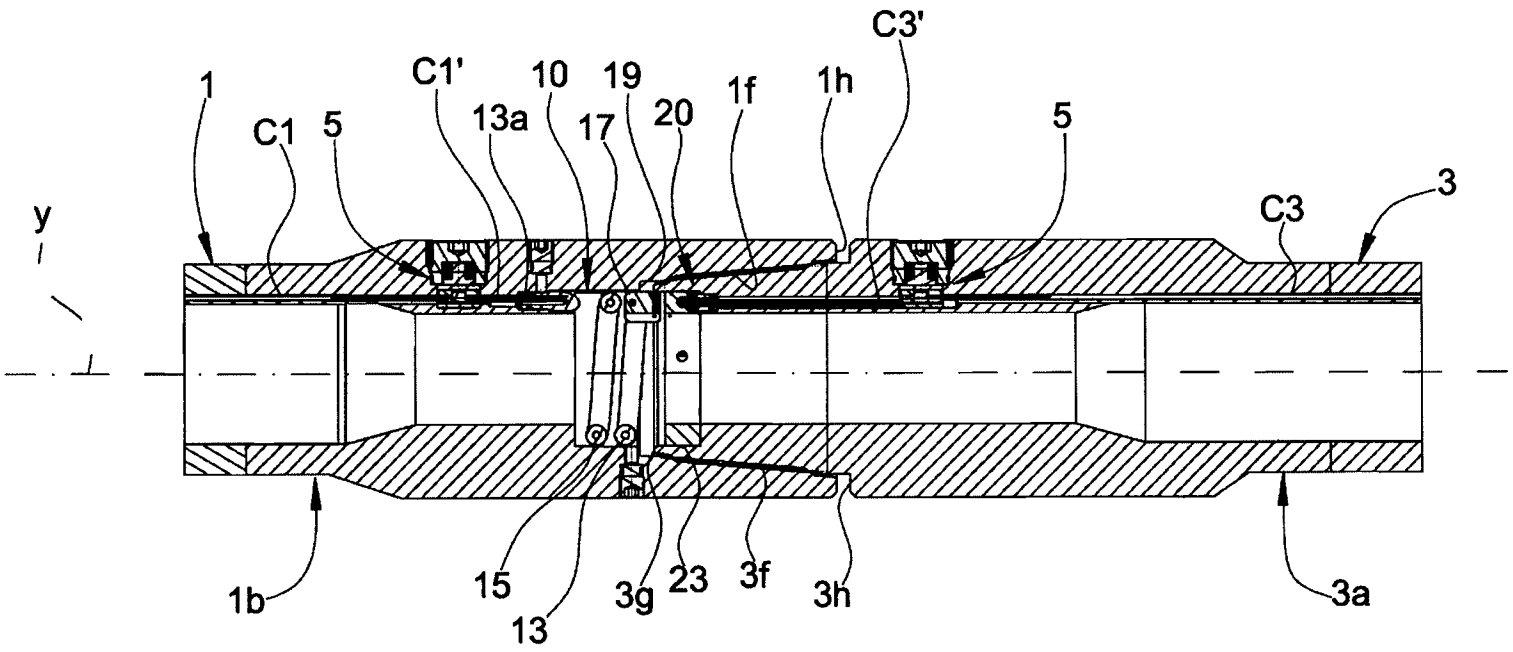
FIG. 11 is a sectional view, similar to FIG. 2, of a pair of drill pipes in accordance with a variant embodiment of the invention.

FIG. 11 shows a variant embodiment in which the first part of the connector 10 comprises a resilient support structure 13 having the form of a right-handed coil spring, unlike the embodiment previously described, in which the spring was left-handed. This is to adapt the electrical connector according to the invention to a different way of screwing. Since the elements of the variant embodiment in FIG. 11 correspond to those of the previous embodiment, they have been designated with the same numerical references, and will not be further described herein.

Figure 12:
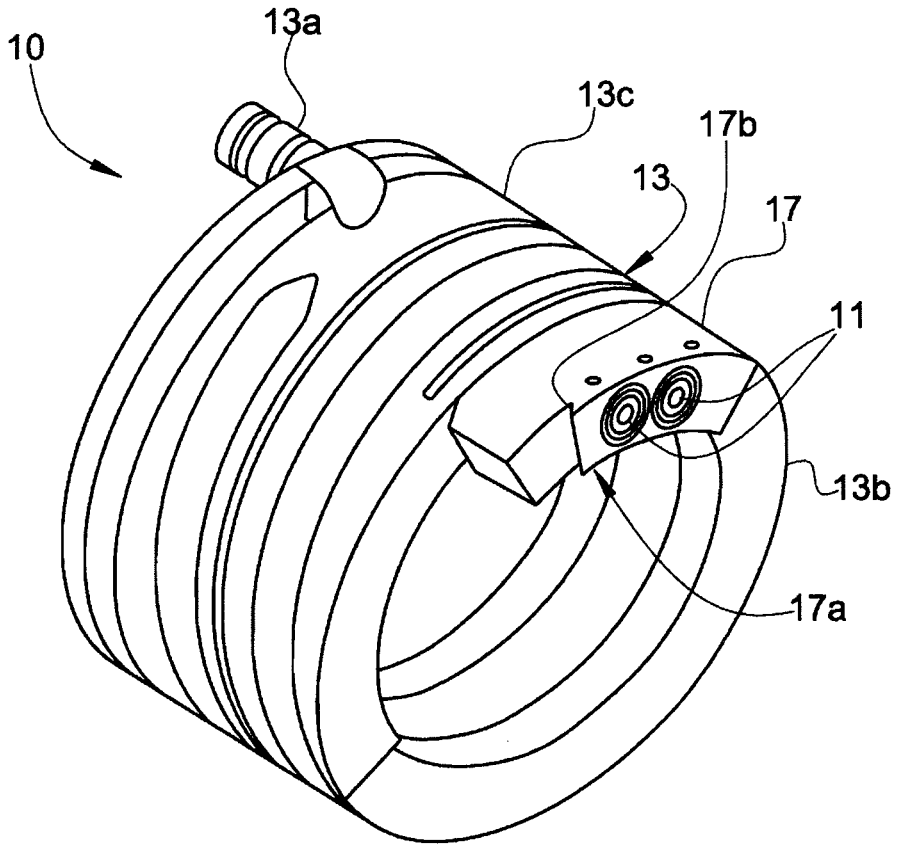
FIG. 12 is a perspective view of a further variant embodiment of the connector according to the invention.

FIG. 12 shows the first connector part according to a variant embodiment in which the first connector part 10 includes a resilient support structure 13 having a tubular shape. This resilient support structure 13 includes a coil spring extending co-axially with the fitting axis y, and having a hollow section body, which spring is similar in structure and function to the coil springs described above. A coating 13*c* of elastomeric material is also a part of the structure 13 of the same variant embodiment, which coating is arranged to cover the space between the coils of the spring in order to provide the continuity of the structure 13. This variant embodiment provides a better sealing than the implementations without an elastomeric coating. Since the elements of the variant embodiment of FIG. 12, except for the coating of elastomeric material, correspond to those of previous embodiments, they have been designated with the same numerical references, and will not be further described herein.

Although the invention will be described as being applied to drill pipes, it will be understood that it is not limited to that specific application, as it can find employment in other technology fields in addition to the drilling of the ground. Accordingly, instead of being supported by respective end elements of drill pipes, the first and second connector parts can be supported, more generally, by first and seconds supports, respectively, which can be assembled to one another by screw- or bayonet-fitting. It is essential that in the fitting movement between these supports a translational movement in the direction of the fitting axis (which in the above-described example coincides with the extension axis y of the pipes 1 and 3) and a rotational movement around the fitting axis are combined.

What is claimed is:

1. An electric connector including a first connector part and a second connector part being couplable to each other and comprising a first contact element and a second contact element, respectively, for closing an electric contact with one another when first and second connector part are coupled to each other, and a first support and a second support which support the first and the second connector part, respectively, and are mountable to one another by means of bayonet or screw fitting for obtaining the coupling between first and second connector part, wherein said first connector part comprises a resilient support structure whose proximal end is fixed to the first support, and whose distal end supports the first contact element, wherein said second connector part comprises an abutment ring adapted to be slidingly engaged by the first contact element during the fitting between first and second support, said abutment ring housing the second contact element, and wherein said second contact element is positioned in a limited circumferential arc of the abutment ring, stop means being provided for stopping the first contact element at the second contact element for realizing the coupling between first and second connector part, wherein in coupled condition the resilient support structure of the first connector part biases the first contact element in axial direction against the abutment ring, and in circumferential direction against said stop means.

2. A connector according to claim 1, wherein said first and second support are end elements of respective components of a drill string, particularly drill pipes.

3. A connector according to claim 1, wherein said resilient support structure comprises a coil spring extending coaxially with the fitting axis of the connector, and whose body has a hollow cross-section for housing an end part of an electric cable electrically connected to the first contact element.

4. A connector according to claim 3, wherein said resilient support structure is tube-like shaped and further comprises an envelope made of elastomeric material which is arranged in such a way as to fill the gaps between coils of the coil spring.

5. A connector according to claim 1, wherein a box-like body open in distal direction is fixed to the distal end of the resilient support structure, the first contact element being housed within the box-like body.

6. A connector according to claim 5, wherein said stop means comprise a projecting formation formed on the abutment ring, which formation protrudes axially with respect to the distal ring surface of the abutment ring, said projecting formation being adapted to be engaged by the box-like body of the first connector part when said first and second connector part are in coupled condition.

7. A connector according to claim 6, wherein said box-like body has a notch formed correspondingly to said projecting formation of the abutment ring.

8. A connector according to claim 7, wherein said projecting formation of the abutment ring and said notch of the box-like body have respective undercut surfaces by means of which they are intended to engage each other.

9. A connector according to claim 5, wherein an intermediate housing is slidingly inserted within said box-like body, said first contact element being slidingly inserted inside said intermediate housing, and wherein resilient means are housed within the box-like body for biasing said first contact element and said housing in distal direction, independently from each other.

10. A connector according to claim 9, wherein said resilient means comprise first resilient means associated to the first contact element and second resilient means associated to the intermediate housing, said first and second resilient means being disposed coaxially with respect to each other.

11. An electric connection device adapted to be coupled to a complementary device, comprising a support adapted to be mounted by means of screw or bayonet fitting to a corresponding support of the complementary device, a contact element for closing an electric contact with a corresponding contact element of the complementary device, and a resilient support structure whose proximal end is fixed to the support, and whose distal end supports the contact element of the electric connection device, wherein said resilient support structure comprises a coil spring extending coaxially with the fitting axis of the electric connection device, and whose body has a hollow cross section for housing an end part of an electric cable electrically connected to the contact element of the electric connection device, wherein a box-like body open in distal direction is fixed to the distal end of the resilient support structure, wherein an intermediate housing is slidingly inserted within the box-like body, the contact element of the electric connection device being slidingly inserted inside the intermediate housing, and wherein resilient means are housed within the box-like body for biasing said contact element and said housing in distal direction, independently from each other.

12. A device according to claim 11, wherein said resilient support structure is tube-like shaped and further comprises an envelope made of elastomeric material which is arranged in such a way as to fill the gaps between coils of the coil spring.

13. A device according to claim 11, wherein said resilient means comprise first resilient means associated to the contact element of the electric connection device and second resilient means associated to the intermediate housing, said first and second resilient means being disposed coaxially with respect to one another.

14. A device according to claim 11, wherein said box-like body has a notch for engaging a corresponding part of the complementary device.

15. A device according to claim 14, wherein said notch of the box-like body has an undercut surface for engaging a corresponding surface of the complementary device.

* * * * *